US006074805A

United States Patent [19]

Badger et al.

[11] Patent Number: 6,074,805

[45] Date of Patent: Jun. 13, 2000

[54] PHOTOGRAPHIC REVERSAL COMPOSITION AND METHOD OF USE

[75] Inventors: John S. Badger, Webster; Mary E. Craver, Rochester, both of N.Y.

[73] Assignee: Eastman Kodak Company, Rochester, N.Y.

[21] Appl. No.: 09/374,431

[22] Filed: Aug. 13, 1999

[51] Int. Cl.[7] ..... G03C 7/407

[52] U.S. Cl. ..... 430/407; 430/379

[58] Field of Search ..... 430/407

[56] References Cited

U.S. PATENT DOCUMENTS

| | | | |
|---|---|---|---|
| 3,617,282 | 11/1971 | Bard et al. | 430/379 |
| 4,921,779 | 5/1990 | Cullinan et al. | 430/379 |
| 4,975,356 | 12/1990 | Cullinan et al. | 430/393 |
| 5,037,725 | 8/1991 | Cullinan et al. | 430/372 |
| 5,523,195 | 6/1996 | Darmon et al. | 430/393 |
| 5,552,264 | 9/1996 | Cullinan et al. | 430/372 |
| 5,736,302 | 4/1998 | Buongiorne et al. | 430/379 |
| 5,811,225 | 9/1998 | McGuckin et al. | 430/407 |

FOREIGN PATENT DOCUMENTS

| | | |
|---|---|---|
| 0 390 317 | 3/1990 | European Pat. Off. . |

*Primary Examiner*—Hoa Van Le
*Attorney, Agent, or Firm*—J. Lanny Tucker

[57] ABSTRACT

Color reversal photographic films are processed using a reversal solution comprising stannous ion and a quaternary ammonium compound as the sole biocide, to reduce formation of biogrowth. The quaternary ammonium compound is present at very low concentrations of 1 to 20 ppm, and is preferably myristyltrimethyl ammonium bromide because it avoids precipitates with components that leach out of processed films.

11 Claims, No Drawings

PHOTOGRAPHIC REVERSAL COMPOSITION AND METHOD OF USE

FIELD OF THE INVENTION

This invention relates in general to color photography and in particular, to a photographic reversal composition and a method of processing color reversal photographic elements. More particularly, the invention relates to an improved reversal composition that has improved antimicrobial agents at low concentration and to a method for its use.

BACKGROUND OF THE INVENTION

Multicolor, multilayer photographic elements are well known in the art. Such materials generally have three different selectively sensitized silver halide emulsion layers coated on one side of a single support. Each layer has components useful for forming a particular color in an image. Typically, the materials utilize color forming couplers or dyes in the sensitized layers during processing.

One commercially important process intended for use with color reversal photographic films useful for providing positive color images, can include the following sequence of steps: first (or black-and-white) development, washing, reversal reexposure, color development, bleaching, fixing, and washing and/or stabilizing. Another useful process is similar but includes stabilizing between color development and bleaching. Such conventional steps are described, for example, in U.S. Pat. No. 4,921,779 (Cullinan et al), U.S. Pat. No. 4,975,356 (Cullinan et al), U.S. Pat. No. 5,037,725 (Cullinan et al), U.S. Pat. No. 5,523,195 (Darmon et al) and U.S. Pat. No. 5,552,264 (Cullinan et al).

Thus, it is known that after the first development, the exposed films are subjected to a reversal reexposure and subsequent color development. Certain nucleating agents have been used in a solution applied after the first development in place of reversal reexposure. Such a solution is known as a "reversal bath". Very early reversal baths contained certain boron compounds as nucleating agents, but they had a number of disadvantages that led to improvements with the use of stannous salts that are stable in both acidic and alkaline environments.

The nucleating agents in the reversal bath are intended to reduce silver ion remaining undeveloped from the first development step. Commercial reversal baths generally contain stannous ion as the silver ion reducing agent, as described for example, in U.S. Pat. No. 3,617,282 (Bard et al). Stannous ion is generally provided in the form of a simple or chelated salt.

Commercial reversal bath solutions, however, can exhibit a number of problems. They may give off an unpleasant odor due to the presence of volatile organic acids typically used as buffers, and undesirable biogrowth may occur in the processing tank. In addition, reversal bath solutions may require filtration after certain hours of use because of the build-up of predominately organic precipitates from high biological matter. Reduction of such biogrowth is a considerable challenge in the art. This would reduce the need for filtration, filter changes and other costly maintenance.

The microbial population in most commercial "seasoned" or used reversal bath solutions is commonly on the order of $10^4$ to $10^5$ CFU/ml (colony forming units/ml). This causes customer dissatisfaction because of the need for more frequent solution replacement and processor tank cleaning. Thus, there is a need to reduce this level of bacterial and fungal organisms in such solutions.

Although there are many known anti-microbial compounds, in order to use them effectively in photographic processing solutions, interactions with components of the processed photographic materials must be avoided. In addition, the anti-microbial compounds must not interact with other components of the processing solutions.

Previous attempts to solve this problem are described in U.S. Pat. No. 5,811,225 (McGuckin et al) in which various quaternary ammonium compounds were used as anti-microbials at 50–150 ppm. The preferred anti-microbial compound in those embodiments was myristyltrimethyl ammonium bromide (MTAB). However, when MTAB or other described anti-microbial compounds were used at the noted concentrations, they tended to react with components (for example, certain filter dyes) that leach out of the processed color reversal films. One reaction product produced is a bright pink precipitate that is unacceptable to customers, requiring costly maintenance and frequent solution replacement.

First of all, there is a need for a low cost reversal bath composition that is not susceptible to the problems noted above (for example biogrowth), and which continues to have the desirable photochemical properties obtained from the use of stannous ion. Preferably, there is a need for a reversal bath composition that does not contain any precipitates from reaction of the anti-microbial compounds with process film components.

SUMMARY OF THE INVENTION

A low cost and microbe-free photographic reversal composition comprises stannous ion at a concentration of from about 0.002 to about 0.02 mol/l, and a quaternary ammonium compound as the sole biocide at a concentration of from about 1 to about 20 ppm, the quaternary ammonium compound having a molecular weight of from about 175 to about 440.

In a preferred embodiment, this composition comprises myristyltrimethyl ammonium bromide (MTAB) as the sole biocide at the concentration of from about 1 to about 20 ppm.

This invention also provides a method of processing a color reversal photographic element comprising:

A) contacting an imagewise exposed, black-and-white developed, color reversal photographic element with any of reversal compositions noted above, and B) color developing the element.

The reversal composition of this invention exhibits reduced biogrowth (both fungal and bacterial) after lengthy use in the reversal bath tank, and this advantage is achieved by including in the composition a specific quaternary ammonium compound as the only biocide. Generally, this material is soluble in solution and does not form complexes with salts in the composition. It is highly compatible with the other essential components of the reversal bath composition, particularly in concentrated form. Thus, biogrowth is reduced without sacrificing photographic quality in the processed element.

In addition, the composition comprises the quaternary ammonium biocide at much lower concentration (from about 1 to about 20 ppm) than previously used or described in U.S. Pat. No. 5,811,225 (noted above). Thus, the precipitates formed at the higher concentrations are avoided, and costs are reduced with the use of less biocide.

In a highly preferred embodiment, the biocide is MTAB at from about 1 to about 20 ppm because it not only inhibits biogrowth but avoids precipitates with components that leach out of the processed element. Thus, the bright pink precipitates noted above are avoided with the use of MTAB at these low concentrations.

DETAILED DESCRIPTION OF THE INVENTION

A wide variety of color reversal photographic elements can be used in the practice of the present invention. A detailed description of such materials is found, for example, in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". More details about such elements are provided herein below. Such elements are generally used to provide color positive images in what are known as color reversal films and papers.

Color reversal photographic elements utilized in the practice of this invention are comprised of a support having on one side thereof a plurality of photosensitive silver halide emulsion layers. The photosensitive layers can contain any of the conventional silver halides as the photosensitive material, for example, silver chloride, silver bromide, silver bromoiodidc, silver chlorobromide, silver chloroiodide, silver chlorobromoiodide, and mixtures thereof. Useful support materials include cellulose acetate film, polyvinylacetal film, polycarbonate film, polystyrene film, polyethylene terephthalate film, and the like. The silver halide is dispersed within a suitable hydrophilic colloid such as gelatin or derivatives thereof. The silver halide emulsion layers can contain a variety of well-known addenda, including but not limited to, chemical sensitizers, development modifiers and antifoggants.

Some specific commercially available color reversal photographic films that can be used in the practice of the present invention include, but are not limited to, EKTACHROME and KODACHROME Color Reversal Films (Eastman Kodak Company), FUJICHROME Color Reversal Films (Fuji Photo Film Co., Ltd.), AGFACHROME Color Reversal Films (AGFA), KONICACHROME Color Reversal Films (Konica) and SCOTCHCHROME Color Reversal Films (Imation).

Color reversal films particularly useful in the practice of this invention include those containing what are known in the art as arylpyrazolone type magenta dye forming color couplers. Such color couplers are well known in the art, as described for example in U.S. Pat. No. 5,037,725 (Cullinan et al).

As explained above, color reversal processes of the prior art utilize a first developer bath, a reversal bath, a color developer bath, a conditioning bath, a bleaching bath, a fixing bath and a stabilizing bath. The components that are useful in each of such baths are well known in the photographic art. The improved process of this invention can utilize the same baths except that the improved reversal composition of this invention is used instead of the conventional reversal bath solutions.

Any processing sequence can be used for the processing the color reversal elements. For example, two conventional processing methods are known as Process E-6 and Process K-14 for color reversal films.

The first developer generally contains a black-and-white developing agent or a mixture thereof. Useful developing agents include, but are not limited to, dihydroxybenzene developing agents (such as hydroquinone), 3-pyrazolidone developing agents (such as 1-phenyl-3-pyrazolidone), ascorbic acid or derivatives thereof, and aminophenol developing agents (such as p-aminophenol). Mixtures of various developing agents can be used to advantage as well. In addition to the developing agent, the first developer typically contains other agents such as preservatives, metal ion sequestering agents, anti-sludging agents, stabilizing agents, contrast-promoting agents, restrainers, halides, hydroxides, antifoggants, buffers and silver halide solvents. Examples of useful black-and-white developing compositions are described in U.S. Pat. No. 5,187,050 (Yamada et al), U.S. Pat. No. 5,683,859 (Nothnagle et al) and U.S. Pat. No. 5,702,875 (Opitz et al), all incorporated herein by reference.

The reversal composition of this invention is used following the first development step. A critical component is a nucleating agent such as stannous ions that are generally provided in the form of stannous salts or chelated stannous salts, as described for example in U.S. Pat. No. 3,617,282 (noted above), incorporated herein by reference. Particularly useful stannous salts include, but are not limited to, stannous chloride, stannous bromide, stannous fluoride and stannous acetate. Stannous chloride is preferred.

Stannous ions are generally present in the composition in an amount sufficient to provide the reversal exposure needed after the first development. The concentration can be at least 0.002 mol/l, and generally does not exceed about 0.02 mol/l. Preferably, the stannous ion concentration is from about 0.004 to about 0.01 mol/l. Sources of stannous ions can be readily purchased from a number of commercial sources.

A second critical component of the reversal composition of this invention is a quaternary ammonium compound that is used as the sole biocide. Such materials have one or more quaternary nitrogen atoms in the molecule, and generally have a molecular weight of at least about 175 and less than about 440. Preferably, the molecular weight is from about 250 to about 420, and more preferably it is from about 300 to about 380.

Each quaternary nitrogen atom in the molecule has its four valences filled with nonpolymeric aliphatic, heterocyclic or carbocyclic groups.

As used herein, "aliphatic" refers to a monovalent organic radical having 1 to 30 carbon atoms in the backbone that can be interrupted with one or more oxy, thio, imino or carbonyl groups. Hydrogen atoms along the backbone can be replaced with fluorine atoms to provide fluorinated aliphatic groups. The aliphatic groups can be substituted with one or more halo atoms, aryl, alkoxy, amino, cycloalkyl or other groups as would be readily apparent to one skilled in the art.

As used herein, the term "heterocyclic" refers to a monovalent organic radical having at least one heterocyclic moiety in the backbone containing one or more oxygen, nitrogen or sulfur atoms. In addition, the heterocyclic group can include a quaternary ammonium group. The heterocyclic group can be aromatic or nonaromatic and generally includes up to 15 atoms in the mono- or polycyclic ring or nucleus that can be substituted with one or more other organic groups if desired as would be readily apparent to one skilled in the art.

The term "carbocyclic" refers to an organic monovalent radical that has all carbon atoms in a mono- or polycyclic ring or nucleus, including cycloalkyl, cycloalkenyl and aryl groups. Such rings generally have up to 14 carbon atoms in the ring structure which can be substituted with one or more other organic groups as would be readily apparent to one skilled in the art.

Useful quaternary ammonium compounds that are biocides for this invention can also be represented by the formula III:

$$R_5(R_6)N^+(R_7)R_8X^-$$

wherein $R_5$, $R_6$, $R_7$ and $R_8$ are independently nonpolymeric aliphatic, heterocyclic or carbocyclic radicals as defined above. $X^-$ is defined below. Preferably, each of the radicals is a monovalent heterocyclic or alkyl group, and the sum of the carbon and hetero atoms in the chains of all four groups is at least 10 and generally less than 20. Most preferably, at least one of the radicals has a chain length of at least 8 carbons, and up to 18 carbons, which can be interrupted with one or more nitrogen or oxygen atoms.

Alternatively, any two or three of the radicals of the noted structure can form a quaternary ring with the nitrogen atom, such as a pyridinium, piperidinium, pyrazinium, quinolinium or morpholino ring.

Particularly useful biocides are those having quaternary nitrogens having its four valences filled with the same or different hydrocarbon groups having 1 to 20 carbon atoms as long as these are at least 10 carbon atoms for at least one group. Preferably, one or two of the hydrocarbon groups have 1 to 3 carbon atoms, and the remaining hydrocarbon groups are considerably larger, for example having at least 8 carbon atoms. More preferably, one of the groups has at least 12 carbon atoms, and each of the remaining groups has only 1 or 2 carbon atoms.

The anions ($X^-$) for the cationic compounds can be any suitable negatively charged monovalent ion such as a halide or anions of small organic or inorganic salts, such as acetates, that does not form a precipitate in solution or otherwise deleteriously affects the action of the reversal solution. Halides, such as chloride and bromide, are preferred.

Representative biocides useful in this invention include, but are not limited to, nonyltrimethyl ammonium bromide, dodecyltrimethyl ammonium chloride, hexadecyltrimethyl ammonium bromide (or cetyltrimethyl ammonium bromide), hexadecyltrimethyl ammonium chloride (or cetyltrimethyl ammonium chloride), benzyltriethyl amnionium chloride, didodecyldimethyl ammonium bromide, benzyldimethylphenyl ammonium chloride, tetrahexyl ammonium chloride, stearyldimethylbenzyl ammonium chloride, cetylpyridinium chloride, benzalkonium chloride (a mixture of alkyldimethylbenzyl ammonium chlorides), a mixture of alkyltrimethyl ammonium bromides (also known as "Cetrimide"), and myristyltrimethyl ammonium bromide. Mixtures of such compounds can be used if desired since many of them are commercially available as mixtures. A most preferred compound is myristyltrimethyl ammonium bromide because it is not only an excellent biocide, but its use results in less formation of precipitates in the processing bath.

Many of these compounds are available from a number of commercial sources, including Lonza Chemicals or Zeeland Chemicals Inc. They may be supplied as pure compounds, aqueous solutions or as aqueous mixtures.

One compound not useful in the present invention is known as Hyamine 1622, benzethonium chloride, or (benzyldimethyl-2-{2-[4-(1,1,3,3-tetramethylbutyl) phenoxy]ethoxy}ethylammonium chloride. Its molecular weight is too high (about 448) and has been observed to result in cloudy solutions and precipitates in concentrated reversal solutions.

The quaternary ammonium compound useful in the practice of this invention is generally present in a concentration of from about 1 to about 20 ppm and preferably from about 1 to about 10 ppm, and more preferably from about 5 to about 10 ppm. The particular amount of a given compound used in the reversal bath composition will depend upon its solubility and other factors. If the compounds have high solubility, the useful concentration may be higher, and the concentration may be even higher if the solution is formulated, stored or used in a concentrated form, as described in U.S. Pat. No. 5,736,302 (Buongiorne et al).

The reversal composition can also include other conventional components such as buffers and sequestering agents, or mixtures thereof. Useful sequestering agents include various known aminocarboxylic acids or aminopolyphosphonic acids or salts thereof.

It may be desirable for the reversal composition to include one or more stannous ion stabilizers as are known in the art. Useful stabilizers include, but are not limited to, p-aminophenol, phenylenediamine and Bandrowski's base. Such stabilizers are present in conventional amounts, that is generally at least about 0.1 mg/l and preferably from about 0.2 to about 0.8 mg/l. p-Aminophenol is preferred.

It is particularly useful for the reversal composition to contain one or more organic phosphonic or phosphinic acid chelating agents. Such chelating agents can be generally represented by the structure I or II:

$$R_1N(CH_2PO_nM_2)_2 \quad (I)$$

or $$R_2R_3C(PO_nM_2)_2 \quad (II)$$

wherein n is 2 or 3, and preferably 3.

$R_1$ is hydrogen, a substituted or unsubstituted alkyl group of 1 to 12 carbon atoms (such as methyl, hydroxymethyl, ethyl, isopropyl, t-butyl, hexyl, octyl, nonyl, decyl, benzyl, 4-methoxybenzyl, phenethyl or o-octamidobenzyl), a substituted or unsubstituted alkylaminoalkyl group (wherein the alkyl portion of the group is an defined above, such as methylaminomethyl or ethylaminoethyl), a substituted or unsubstituted alkoxyalkyl group of 1 to 12 carbon atoms (such as methoxymethyl, methoxyethyl, propoxyethyl, benzyloxy, methoxymethylenemethoxymethyl, or t-butoxy), a substituted or unsubstituted cycloalkyl group of 5 to 10 carbon atoms (such as cyclopentyl, cyclohexyl, cyclooctyl or 4-methylcyclohexyl), a substituted or unsubstituted aryl group of 6 to 10 carbon atoms (such as phenyl, xylyl, tolyl, naphthyl, p-methoxyphenyl or 4-hydroxyphenyl), or a substituted or unsubstituted 5- to 10-membered heterocyclic group having one or more nitrogen, oxygen or sulfur atoms in the ring besides carbon atoms [such as pyridyl, pyrimidyl, pyrrolyldimethyl, pyrrolyldibutyl, benzothiazolylmethyl, tetrahydroquinolylmethyl, 2-pyridinylmethyl, 4-(N-pyrrolidino)butyl or 2-(N-morpholino)ethyl].

$R_2$ is hydrogen, a substituted or unsubstituted alkyl group of 1 to 12 carbon atoms (as defined above), a substituted or unsubstituted aryl group of 6 to 10 carbon atoms (as defined above), a substituted or unsubstituted cycloalkyl group of 5 to 10 carbon atoms (as defined above), a substituted or unsubstituted 5- to 10-membered heterocyclic group (as defined above), $—PO_nM_2$ or $—CHR_4PO_nM_2$.

$R_3$ and $R_4$ are independently hydrogen, hydroxyl, a substituted or unsubstituted alkyl group of 1 to 12 carbon atoms (as defined above) or $—PO_nM_2$.

M is hydrogen or a water-soluble monovalent cation imparting water-solubility such as an alkali metal ion (for example sodium or potassium), or ammonium, pyridinium, triethanolammonium, triethylammonium ion or others readily apparent to one skilled in the art. The two cations in each molecule do not have to be the same. Preferably, M is hydrogen, sodium or potassium.

In defining the substituted monovalent groups herein, useful substituents include, but are not limited to, an alkyl group, hydroxy, sulfo, carbonamido, sulfonamido, sulfamoyl, sulfonato, thioalkyl, alkylcarbonamido, alkylcarbamoyl, alkylsulfonamido, alkylsulfamoyl, carboxyl, amino, halo (such as chloro or bromo) sulfono, or sulfoxo, alkoxy of 1 to 5 carbon atoms (linear or branched), $—PO_nM_2$, $—CH_2PO_nM_2$ or $—N(CH_2PO_nM)_2$ wherein the alkyl (linear or branched) for any of these groups has 1 to 5 carbon atoms.

Representative phosphonic acids useful in the practice of this invention include, but are not limited to the compounds listed in EP 0 428 101 A1 (page 4). Representative useful compounds are 1-hydroxyethylidene-1,1-diphosphonic acid, diethylenetriaminepentaphosphonic acid, ethylenediamine-N,N,N',N'-tetramethylenephosphonic acid, nitrilo-N,N,N-trimethylenephosphonic acid [also known as aminotris (methylenephosphonic acid)], 1,2-cyclohexanediamine-N, N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diamino-2-propanol-N,N,N',N'-tetramethylenephosphonic acid, 1,3-propanediamine-N,N,N', N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridinylmethylamine-N,N-dimethylenephosphonic acid, 1-hydroxyethane- 1,1-diphosphonic acid, diethylenetriamine-N,N,N',N",N"-penta (methylenephosphonic acid), 1-hydroxy-2-phenylethane-1,1-diphosphonic acid, 2-hydroxyethane- 1,1-diphosphonic acid, 1-hydroxyethane-1,1,2-triphosphonic acid, 2-hydroxyethane-1,1,2-triphosphonic acid, ethane-1,1-diphosphonic acid, and ethane-1,2-diphosphonic acid, amino tris(methylenephosphonic acid), or salts thereof.

Particularly useful are 1-hydroxyethylidene-1,1-diphosphonic acid, aminotris(methylenephosphonic acid), diethylenetriamine-N,N,N',N",N"-penta (methylenephosphonic acid), or salts thereof. The second compound is most useful.

One or more of the phosphonic or phosphinic acids defined above are present in conventional amounts, and generally in an amount of at least about 2 g/l.

It is particularly desirable that the reversal composition have a pH of from about 4 to about 8, and preferably at from about 5 to about 7, when in the form of an aqueous solution. This can be achieved in suitable chemical acids or bases, or buffers, as needed.

The composition of this invention may be formulated in solid form such as a powder, pellets, tablet and the like that upon dissolution provides the composition of this invention.

Conventional color developing solutions can be used in the practice of this invention. In addition to an aromatic primary amino color developing agent, the color developing bath typically contains sequestering agents, buffering agents, preservatives, competing couplers and silver halide solvents that are commonly used in the industry for this purpose. Examples and amounts of such conventional compositions and components are described for example in U.S. Pat. No. 5,037,725 (Cullinan et al) and U.S. Pat. No. 5,552,264 (Cullinan et al), both incorporated by reference.

Particularly useful aromatic primary amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include but are not limited to: N,N-diethyl-p-phenylenediamine monohydrochloride 4-N,N-diethyl-2-methylphenylene-diamine monohydrochloride, 4-(N-ethyl-N-2-methane-sulfonylaminoethyl)-2-methylphenylenediamine sesquisulfate monohydrate, 4-(N-ethyl-N-2-hydroxyethyl)-2-methyl-phenylenediamine sulfate, 4-N,N-diethyl-2,2'-methanesulfonylamino-ethyl-phenylenediamine hydrochloride, and others readily apparent to a skilled worker in the art.

Conventional pre-bleach or conditioning solutions can be used in the practice of the present invention, as described for example in U.S. Pat. No. 4,839,262 (Schwartz), U.S. Pat. No. 4,921,779 (Cullinan et al), U.S. Pat. No. 5,037,725 (Cullinan et al), U.S. Pat. No. 5,523,195 (Darmon et al), U.S. Pat. No. 5,552,264 (Cullinan et al), all incorporated herein by reference. Preferred conditioning solutions include aliphatic thiol bleach accelerating agents, formaldehyde precursors (such as sodium fonnaldehyde bisulfite or hexamethylenetetraamine), secondary amines, sulfites as preservatives, buffering agents, and metal ion sequestering agents.

The essential component of a bleaching bath useful in this invention is a bleaching agent that converts metallic silver to silver ions. Other common components of the bleaching bath include halides, metal ion sequestering agents, optical brighteners, preservatives, biocides, antioxidants, anti-fungal agents, anti-foam agents, buffers and corrosion inhibitors. Ammonium or alkali metal salts of a ferric complex of an aminopolycarboxylic acid are particularly useful as bleaching agents but other metal complexes are known in the art, including binary and ternary complexes. Also of utility are the persulfate bleaching agents such as ammonium or alkali metal persulfates and peroxide bleaching agents. Bleaching agents can be used individually or in the form of mixtures of two or more bleaching agents. Examples of biodegradable bleaching agents include those described in U.S. Pat. No. 5,670,305 (Gordon et al) and in U.S. Ser. No. 09/283,396 (Price) filed Apr. 1, 1999. Such bleaching agents include iron complexes of one or more biodegradable chelating ligands including alkyliminodiacetic acids, aminodisuccinic acids, aminomonosuccinic acids, alaninediacetic acid, pyridinecarboxylic acids, pyridinedicarboxylic acids, nitrilotriacetic acid, glycinesuccinic acid and 2-pyridylmethyliminodiacetic acid.

A fixing solution converts all silver halide into soluble silver complexes that diffuse out of the emulsion layers. Fixing solution retained within the layers of the photographic element is removed in a subsequent water washing step. Thiosulfates, including ammonium thiosulfate and alkali metal thiosulfates (such as sodium thiosulfate and potassium thiosulfate), are particularly useful as fixing agents. Other components of the fixing solution include preservatives, fixing accelerators, buffers and metal ion sequestering agents. Further details of useful fixing solutions are described in the art, including the Cullinan et al patents noted above. It may also be useful to include one or more uncomplexed aminodisuccinic acids in the fixing solution as described in U.S. Ser. No. 09/283,396 of Price noted above.

Bleach-fixing solutions may be useful in the process of this invention. Such solutions are well known in the art and generally include one or more components of the bleaching and fixing solutions described above.

A final rinse composition can be used in the process as a final processing bath. Such compositions can include one or more surfactants (anionic, nonionic or both), biocides, metal chelating agents, buffers and other components known in the art, as described for example in U.S. Pat. No. 3,545,970 (Giorgianni et al), U.S. Pat. No. 5,534,396 (McGuckin et al), U.S. Pat. No. 5,645,980 (McGuckin et al), U.S. Pat. No. 5,667,948 (McGuckin et al) and U.S. Pat. No. 5,716,765 (McGuckin et al), all of which are incorporated herein by reference.

A wide variety of different color reversal processes are well known in the art. For example, a single color developing step can be used when the coupling agents are incorporated in the photographic element or three separate color developing steps can be used in which coupling agents are included in the developing solutions. In order to provide shorter processing times, bleaching and fixing can be combined in a single step (bleach-fixing step).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

The color reversal elements are typically exposed to suitable radiation to form a latent image and then processed as described above to form a visible positive color image.

The conditions (time and temperature) for the various steps of the method of this invention are well known in the art. The reversal step, in particular, is carried out for from about 45 to about 200 seconds at a temperature of from about 20 to about 40° C. Times and temperatures outside these ranges can be used if desired.

Processing according to the present invention can be carried out using conventional deep tanks holding processing solutions. The tanks or stages can be arranged in countercurrent or concurrent flow. Alternatively, it can be carried out using what is known in the art as "low volume thin tank" processing systems having either rack and tank or automatic tray designs. Such processing methods and equipment are described, for example, in U.S. Pat. No. 5,436,118 (Carli et al) and publications noted therein.

The following examples are provided for illustrative purposes only and are not intended to be limiting in any way. Unless otherwise indicated, all percentages are by weight.

EXAMPLES 1–6

Reversal Solutions with Various Biocides

Several working strength reversal compositions of this invention were prepared as follows:

A concentrated reversal bath formulation (without biocide) was prepared with the following components:

| | |
|---|---|
| Tap water | 840.0 g/l |
| DEQUEST 2000* (50%) | 125.36 g/l |
| Sodium hydroxide (50%) | 78.0 g/l |
| Stannous chloride, anhydrous | 33.0 g/l |
| p-Aminophenol | 0.01 g/l |
| To provide 1 liter of solution. | |

*DEQUEST 2000 is a 50% (by weight) solution of aminotris-(methylenephosphonic acid) available from Monsanto Co.

The concentrated solution was diluted to a working strength solution with tap water (19:1), and 200 ml aliquots were distributed into glass jars. The biocide being evaluated (at various concentrations) was added to a given jar along with 2 ml of an inoculum comprised of "seasoned" reversal bath solution from a commercial Hope 296 processing machine. The microbial concentration (various bacterial and fungal organisms) of the inoculum was at least about $10^6$ CFU/ml. Upon addition to the cups, the inoculum microbial concentration was thusly diluted 100:1 (to $10^4$ CFU/ml).

Each jar and solution was incubated at 30° C., and samples were taken from each jar after 7 days. The levels of biogrowth were determined visually.

The following quaternary ammonium compounds were evaluated as the sole biocides in the samples noted above.

Example 1: Myristyltrimethyl ammonium bromide (MTAB).

Example 2: Benzalkonium chloride (commercial mixture of alkyldimethylbenzyl ammonium chlorides).

Example 3: Cetylpyridinium chloride ("CPC").

Example 4: Cetyltrimethyl ammonium bromide ("CTAB").

Example 5: Cetyldimethylethyl ammonium bromide ("CDEAB").

Example 6: Commercial mixture of alkyltrimethyl ammonium bromides ("ATAB", available as "Cetrimide").

TABLE I below lists the results of microbial counts for the samples after 7 days incubation.

TABLE I

| SOLUTION | AMOUNT OF BIOCIDE (ppm) | 7 DAY BIOGROWTH | COMMENTS |
|---|---|---|---|
| Control | 0 | Significant growth | no precipitate |
| Example 1 | 1 | Moderate growth | no precipitate |
| Example 1 | 2 | Some growth | no precipitate |
| Example 1 | 3 | Very little growth | no precipitate |
| Example 1 | 5 | No growth | no precipitate |
| Example 1 | 10 | No growth | no precipitate |
| Example 2 | 5 | No growth | crystalline material on solution surface |
| Example 2 | 10 | No growth | crystalline material on solution surface |
| Example 2 | 20 | No growth | crystalline material on solution surface |
| Example 3 | 5 | No growth | crystalline material on solution surface |

TABLE I-continued

| SOLUTION | AMOUNT OF BIOCIDE (ppm) | 7 DAY BIOGROWTH | COMMENTS |
|---|---|---|---|
| Example 3 | 10 | No growth | crystalline material on solution surface & in solution |
| Example 3 | 20 | No growth | crystalline material on solution surface & in solution |
| Example 4 | 5 | No growth | crystalline material on solution surface |
| Example 4 | 10 | No growth | crystalline material on solution surface |
| Example 4 | 20 | No growth | crystalline material on solution surface |
| Example 5 | 5 | No growth | crystalline material on solution surface |
| Example 5 | 10 | No growth | crystalline material on solution surface |
| Example 5 | 20 | No growth | crystalline material on solution surface |
| Example 6 | 5 | No growth | crystalline material on solution surface |
| Example 6 | 10 | No growth | crystalline material on solution surface |
| Example 6 | 20 | No growth | crystalline material on solution surface |

The results of these experiments showed that all of the quaternary ammonium compounds are useful as the sole biocides in reversal bath compositions of this invention. However, only myristyltrimethyl ammonium bromide inhibited all precipitate formation in addition to inhibiting biogrowth.

EXAMPLE 7

Evaluation of Dye Compatability

As described above, filter dyes may leach into the reversal bath and can react with some of the biocides described herein and form an undesirable pink precipitate in the bath.

The reversal bath concentrate and working strength composition of Examples 1–7 was distributed in 10 ml aliquots to 25 ml vials. The biocide being evaluated (at various concentrations) was added to a given vial along with about 0.4 ml (10 drops) of a filter dye solution (comprised of 4 g of a conventional filter dye* in 100 of 1% potassium carbonate). Each vial was observed visually to see if precipitates formed after 1 day. *The filter dye was benzoic acid, 4-{{4-{3-[1-(4-carboxyphenyl)-1,5-dihydro-3-methyl-5-oxo-4H-pyrazol-4-ylidene]-1-propenyl}-5-hydroxy-3-methyl-1H-pyrazol-1-yl}}.

In addition to the biocides tested in Examples 1–6, cetyltrimethyl ammonium chloride (CTAC) was tested in the reversal bath composition (Example 7).

TABLE II shows the results of these experiments.

TABLE II

| SOLUTION | AMOUNT OF BIOCIDE (ppm) | OBSERVATIONS |
|---|---|---|
| Control | 0 | Clear pink solution |
| Example 1 | 1 | Clear pink solution |
| Example 1 | 2 | Clear pink solution |
| Example 1 | 3 | Clear pink solution |
| Example 1 | 5 | Clear pink solution |
| Example 1 | 10 | Clear pink solution |
| Example 2 | 5 | Pink residue on vial |
| Example 2 | 10 | Pink residue on vial |
| Example 2 | 20 | Pink residue on vial |
| Example 3 | 5 | Pink precipitate in solution |
| Example 3 | 10 | Pink precipitate in solution |
| Example 3 | 20 | Pink precipitate in solution |
| Example 4 | 5 | Pink precipitate in solution |
| Example 4 | 10 | Pink precipitate in solution |
| Example 4 | 20 | Pink precipitate in solution |
| Example 5 | 5 | Pink precipitate in solution |
| Example 5 | 10 | Pink precipitate in solution |
| Example 5 | 20 | Pink precipitate in solution |
| Example 6 | 5 | Pink flocculent material |
| Example 6 | 10 | Pink flocculent material |

TABLE II-continued

| SOLUTION | AMOUNT OF BIOCIDE (ppm) | OBSERVATIONS |
|---|---|---|
| Example 6 | 20 | Pink precipitate in solution |
| Example 7 | 5 | Pink precipitate in solution |
| Example 7 | 10 | Pink precipitate in solution |
| Example 7 | 20 | Pink precipitate in solution |

These experiments demonstrated that the best biocide is MTAB because it does not react with the filter dye that may be present in some color reversal elements. The other compounds were acceptable as biocides at the lower concentrations but did react with the filter dye.

EXAMPLE 8

Processing Reversal Color Photographic Film with Preferred Reversal Solutions

"MTAB" (Example 1 above) was incorporated into reversal bath compositions as the sole biocide as used in processing various color reversal films. The concentrated reversal bath replenisher formulation and working strength composition were formulated as follows:

| COMPONENT | WORKING STRENGTH REPLENISHER SOLUTION | CONCENTRATE REPLENISHER SOLUTION (20 x) * |
|---|---|---|
| Water | 800 ml | 600 ml |
| DEQUEST 2000 metal sequestering agent (50%) | 6.25 g | 125 g |
| NaOH (50%) | 9.0 g | 180 g |
| Acetic acid | 5.25 g | 105 g |
| $SnCl_2$ | 1.65 g | 33 g |
| p-Aminophenol | 0.0005 g | 0.01 g |
| MTAB | 10 ppm | 200 ppm |
| Water to make | 1 liter | 1 liter |
| pH | 5.45 | 5.40 |

* A fresh tank of solution is made by either taking 800 ml of replenisher or 40 ml of the concentrated replenisher and diluting it to 1 liter with water.

The seasoning test comprised three consecutive experimental runs. In each run of the seasoning test, the processing machine, a commercially available Colex Model 7/6 EKTACHROME roller transport processor, was thoroughly cleaned and fresh reversal solution was introduced. In the two Control runs of the seasoning test, the reversal solution was KODAK Reversal Bath and Replenisher, Process E-6.

The reversal composition of the invention was used in the second experimental run (Invention).

Each reversal solution was then replenished while processing KODAK Professional EKTACHROME E100S Film to four tank turnovers. Additional films that were similarly processed included KODAK EKTACHROME Duplicating Film 6121, KODAK Professional EKTACHROME E100VS Film, KODAK Professional EKTACHROME E200 Film KODAK EKTACHROME 100 Plus Professional Film/EPP, KODAK EKTACHROME 64 Professional Film/EPR, AGFACHROME RSX100 Film, FUJI VELVIA Film FUJI PROVIA 100 Film and FUJI PROVIA 400 Film.

One tank turnover refers to the equivalent of replacing one tank volume with a combination of solution carried in from the previous processing tank and fresh replenisher solution. A fully seasoned processing solution requires about 3 tank turnovers. The test was carried out to four tank turnovers to maximize the probability for biogrowth.

Film processing utilized the following conventional reversal ("Process E-6"processing protocol at conventional temperatures:

| | |
|---|---|
| First Development * | 6 minutes |
| Water wash | 2 minutes |
| Reversal solution ** | 2 minutes |
| Color development *** | 6 minutes |
| Prebleach **** | 2 minutes |
| Bleaching $ | 6 minutes |
| Fixing # | 4 minutes |
| Water wash | 4 minutes |
| Final wash ## | 1 minute |
| Drying | |

* First Development used conventional KODAK First Developer for Process E-6.
** Reversal solution described above.
*** Color development used conventional KODAK Color Developer for Process E-6.
**** Prebleaching using KODAK Prebleach II & Replenisher for Process E-6.
$ Bleaching using conventional KODAK Bleach for Process E-6.
Fixing used conventional KODAK Fixer for Process E-6.
Final washing used KODAK Final Rinse for Process E-6.

In the experimental run in which the invention was practiced, the level of bacteria was reduced significantly and fungal growth well controlled. In the two Control experimental runs, the bacterial counts were not reduced. During the processing using the invention, the reversal bath solution turned pink in color, but no precipitates were observed in the solution or attached to the processor parts.

The invention has been described in detail with particular reference to preferred embodiments thereof, but it will be understood that variations and modifications can be effected within the spirit and scope of the invention.

We claim:

1. A precipitate-free photographic reversal composition comprising stannous ion at a concentration of from about 0.002 to about 0.02 mol/l, and myristyltrimethyl ammonium bromide as the sole biocide at a concentration of from about 5to about 20 ppm.

2. The composition of claim 1 wherein said stannous ion concentration is from about 0.004 to about 0.01 mol/l.

3. The composition of claim 1 further comprising a stannous ion stabilizer, an organic phosphonic acid or phosphinic acid chelating agent, a chemical base, a buffer, or a mixture thereof.

4. The composition of claim 1 having a pH of from about 4 to about 8.

5. The composition of claim 1 further comprising an organic phosphonic or phosphinic acid chelating agent at a concentration of at least about 2 g/l.

6. The solution of claim 5 wherein said organic phosphonic or phosphinic acid chelating agent is represented by the structure I or II:

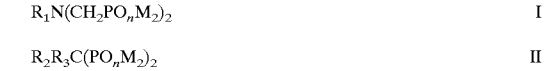

$$R_1N(CH_2PO_nM_2)_2 \quad \text{I}$$

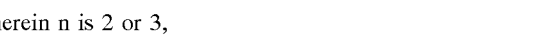

$$R_2R_3C(PO_nM_2)_2 \quad \text{II}$$

wherein n is 2 or 3, $R_1$ is hydrogen, alkyl of 1 to 12 carbon atoms, alkylaminoalkyl wherein each alkyl portion has 1 to 12 carbon atoms, alkoxyalkyl of 2 to 12 carbon atoms, cycloalkyl of 5 to 10 carbon atoms in the ring, or a 5- to 10-membered heterocyclic group having one or more nitrogen, oxygen or sulfur atoms in the heterocyclic ring, $R_2$ is hydrogen, alkyl of 1 to 12 carbon atoms, aryl of 6 to 10 carbon atoms in the aromatic ring, cycloalkyl of 5 to 10 carbon atoms in the ring, a 5- to 10-membered heterocyclic group having one or more nitrogen, oxygen or sulfur atoms in the heterocyclic ring, $—PO_nM_2$ or $—CHR_4PO_nM_2$, $R_3$ and $R_4$ are independently hydrogen, hydroxy, alkyl of 1 to 12 carbon atoms, or $—PO_nM_2$, and M is hydrogen or a water-soluble cation.

7. A photographic reversal composition having a pH of from about 4 to about 7 and comprising:

a) stannous ion at a concentration of from about 0.004 to about 0.01 mol/l, b) a quaternary ammonium compound as the sole biocide at a concentration of from about 5 to about 20 ppm, said quaternary ammonium compound being myristyltrimethyl ammonium bromide, c) a stannous ion stabilizer, and d) an organic phosphonic or phosphinic acid chelating agent.

8. A method of processing a color reversal photographic film comprising:

A) contacting an imagewise exposed color reversal photographic film with the reversal composition of claim 1, and B) color developing said film.

9. The method of claim 8 further comprising bleaching, fixing, and washing or stabilizing said color developed film.

10. The method of claim 8 wherein said reversal solution comprising stannous ion at a concentration of from about 0.004 to about 0.01 mol/l, said quaternary ammonium compound is present at a concentration of from about 5 to about 10 ppm, and said solution further comprises an organic phosphonic or phosphinic acid chelating agent at a concentration of at least about 2 g/l.

11. The method of claim 8 wherein said quaternary ammonium compound is present in said composition in an amount of from about 5 to about 10 ppm.

* * * * *

UNITED STATES PATENT AND TRADEMARK OFFICE

CERTIFICATE OF CORRECTION

PATENT NO. : 6,074,805

DATED : June 13, 2000

INVENTOR(S) : John S. Badger, et. al.

It is certified that error appears in the above-indentified patent and that said Letters Patent is hereby corrected as shown below:

ABSTRACT, line 3 delete "biocide" and substitute - - biogrowth control agent - -

Col. 1, line 10, delete "antimicrobial" and insert - - biogrowth control agent - -.

Col. 2, lines 1-2, 5, 13, 26, delete "anti-microbial compounds" and insert - - biogrowth control agent Col. 2, lines 9-10, delete "anti-microbials" and insert - - biogrowth control agent - -.

Col. 2, lines 34, 40, 52, 60, 64, 65, delete "biocide" and insert - - biogrowth control agent - -.

Col. 4, line 33, delete "biocide" and insert - - biogrowth control agent - -.

Col. 5, lines 1-2, 19, 36, delete "biocides" and insert - - biogrowth control agent - -.

Col. 5, line 52, delete "biocide" and insert - - biogrowth control agent - -.

Col. 10, line 2, delete "Biocides" and insert - - biogrowth control agent - -.

Col. 10, lines 7, 22, delete "biocide" and insert - - biogrowth control agent - -.

UNITED STATES PATENT AND TRADEMARK OFFICE

CERTIFICATE OF CORRECTION

PATENT NO. : 6,074,805
DATED : June 13, 2000
INVENTOR(S) : John s. Badger, et. al.

It is certified that error appears in the above-indentified patent and that said Letters Patent is hereby corrected as shown below:

Col. 10, lines 36, delete "biocides" and insert - - biogrowth control agent - -.

Cols. 10-11, TABLE I, heading, col. 2, delete "BIOCIDE" and insert - - BIOGROWTH CONTROL AGENT - -.

Col. 11, lines 21, 29, 42, delete "biocides" and insert - - biogrowth control agent - -.

Col 11, line 33, delete "biocide" and insert - - biogrowth control agent - -.

Col. 11-12, TABLE II, heading, col. 2, delete "BIOCIDE" and insert - - BIOGROWTH CONROL AGENT - -.

Col. 12, lines 28, 39, delete "biocide" and insert - - biogrowth control agent - -.

Col. 12, line 32, delete "biocides" and insert - - biogrowth control agent - -.

Col. 13, Claim 1, line 55, delete "biocide" and insert - - biogrowth control agent - -.

Col. 14, Claim 7, b), line 35, delete "biocide" and insert - - biogrowth control agent - -.

Signed and Sealed this

Tenth Day of April, 2001

*Attest:*

Nicholas P. Godici

NICHOLAS P. GODICI

*Attesting Officer*

*Acting Director of the United States Patent and Trademark Office*